US007124500B2

(12) United States Patent
Sollanek et al.

(10) Patent No.: US 7,124,500 B2
(45) **Date of Patent: *Oct. 24, 2006**

(54) PINCH GRIP HANGER LOADING MECHANISM

(75) Inventors: Jeffrey R. Sollanek, Asheville, NC (US); Stanley F. Gouldson, Northport, NY (US)

(73) Assignee: Spotless Plastics Pty. Ltd., Victoria (AU)

( * ) Notice: Subject to any disclaimer, the term of this patent is extended or adjusted under 35 U.S.C. 154(b) by 297 days.

This patent is subject to a terminal disclaimer.

(21) Appl. No.: 10/790,286

(22) Filed: Mar. 1, 2004

(65) Prior Publication Data

US 2004/0163239 A1 Aug. 26, 2004

Related U.S. Application Data

(63) Continuation of application No. 10/076,789, filed on Feb. 15, 2002, now Pat. No. 6,711,808.

(51) Int. Cl.
*B23Q 7/10* (2006.01)
*B23P 21/00* (2006.01)
*B23P 11/02* (2006.01)

(52) U.S. Cl. ..... 29/809; 29/717; 29/714; 29/281.5; 221/239; 221/270

(58) Field of Classification Search ..... 29/714, 29/787, 789, 809, 822, 243.56, 281.5, 241, 29/433, 717; 221/194, 195, 196, 268, 270, 221/271, 272, 274, 276, 239, 255, 257; 223/96, 223/91, 95, 111
See application file for complete search history.

(56) References Cited

U.S. PATENT DOCUMENTS 3,824,671 A * 7/1974 Watkin ..... 29/717
3,859,710 A * 1/1975 Batts et al. ..... 29/235
4,349,127 A * 9/1982 Savard, Jr. ..... 221/196
4,381,599 A * 5/1983 Duester et al. ..... 29/717
4,383,362 A * 5/1983 Graniero et al. ..... 29/822
4,873,878 A * 10/1989 Milton ..... 73/865.8
5,507,086 A * 4/1996 Marshall et al. ..... 29/453
5,568,685 A * 10/1996 Marshall et al. ..... 29/809
6,421,910 B1 * 7/2002 Marshall et al. ..... 29/822
6,711,808 B1 * 3/2004 Sollanek et al. ..... 29/717

FOREIGN PATENT DOCUMENTS

WO WO 3070421 A1 * 8/2003

* cited by examiner

*Primary Examiner*—Essama Omgba
(74) *Attorney, Agent, or Firm*—Scully, Scott, Murphy & Presser

(57) ABSTRACT

A pinch grip hanger mechanism dispenses pinch grip hangers, one at a time, and then opens the pinch grips for insertion of a garment. The insertion of a garment triggers the closing of the pinch grips, and reciprocation of a hanger feed push plate to dispense another hanger. The device may also automatically attach size indicia to the hanger as the hanger is dispensed. The closing of the pinch grips is initiated by safety triggers, which are triggered by insertion of a garment. This provides a safety feature for the device, since the operator needs to use both hands to hold the garment taut for insertion. Thus, both hands are away from the device at the time the pinch grips are opened and closed.

15 Claims, 6 Drawing Sheets

PINCH GRIP HANGER LOADING MECHANISM

CROSS-REFERENCE TO RELATED APPLICATIONS

This application is a continuation of U.S. patent application Ser. No. 10/076,789, filed 15 Feb. 2002, now U.S. Pat. No. 6,711.808 the complete disclosure of which is hereby incorporated by reference for all purposes.

BACKGROUND OF THE INVENTION

1. Field of Invention

The present invention relates generally to a pinch grip hanger mechanism, and more particularly pertains to a clip hanger loading mechanism providing a fast and efficient mechanism and method for loading garments into pinch grip clip hangers.

2. Description of Related Art

Consumer taste and fashion have dictated a desire for mass-produced, but well-fitted garments, which are distributed and sold throughout the United States. Large national retailers of clothing generally contract with a plurality of clothing manufacturers to produce uniform standardized clothing, which is essentially identical from batch to batch, even though manufactured by different entities. These manufacturers in turn produce the clothing at their own plants, or in many cases, subcontract the production of the garments to manufacturers based in the Far East, for instance, in Hong Kong, Taiwan, Singapore and South Korea.

In the retail clothing industry clothing is typically suspended from hangers at the point of purchase. Such hangers are often inexpensive ship-on types and under prevailing garment-on-hanger programs, the garment is shipped from the manufacturer to the retailer while suspended from a hanger. However, the time and labor costs associated with the operation of taking each hanger, loading a garment into the hanger and then placing the hanger with the garment affixed thereon in a suitable form for shipment is not insignificant at the manufacturing level.

For these reasons the industry has developed a variety of devices partially automating the operation of suspending garments from hangers. In U.S. Pat. No. 4,349,127 to Savard a device is provided which holds a stack of hangers and, when the operator is ready for the operation of affixing the garment thereon, feeds the hangers one by one in a position suitable for carrying out the operation. After one hanger with the garment affixed thereon is removed, the device permits the next hanger to be automatically fed to the operator who affixes the next garment thereon.

Another device which automatically advances hangers, one at a time, to an operator is the Hangermatic 589 manufactured by Trim-Master, 4860 North 5th Street Highway, Temple, Pa. The Hangermatic 589 includes a pair of magazine towers, which contain a vertical stack of hangers there between. The hangers rest on a plate member and are selectively engaged by a reciprocating plate, which selectively engages the lowermost hanger and urges it outwardly to a stop means on an outer plate, which becomes extended. The hanger is thereby held in an extended position at which point the operator may affix a garment to the hanger and then remove the hanger. After removal of the hanger the outer plate, which is spring loaded returns to the inner plate activating a control, which returns the reciprocating plate to its original position. In a fully automatic mode, the reciprocating plate returns to pick up another hanger from the magazines and advance it to the extended position.

A modified form of this device that provided automatic feed for pants hangers having a steel spring clam shell design was also developed. In this hanger, a steel retaining clip was manually clamped over the clam shell to secure the garment. Use of the hangers in this device required a manual operation to slide the steel clip over the clam shell to close the retention clip on the garment.

For purposes of displaying garments suspended on hangers in an orderly and attractive manner to the retail customer, it is often desired to affix an indicating means on the hanger in a position visible to the retail customer while the hanger is suspended on a rack. The indicating means identifies some attribute of the garment suspended from the hanger, such as size, quality, color, manufacturing data, or pattern.

To accommodate the various types of hangers available in the industry numerous indicating means have been developed in a variety of shapes, sizes and materials. For instance, U.S. Pat. Nos. 4,322,902, Des. 341,947 and Des. 332,180 and World Publication No. 90/09651 all disclose plastic indicia-bearing caps attached to the top of the hook. In U.S. Pat. Nos. 4,115,940, 5,096,101, 5,199,608 and 5,238,159, indicia-bearing flanges which attach an indicia-bearing sizer substantially at the junction of both the hook and the body member are disclosed.

Typically, the indicating means are manually affixed. However, a system for automatically affixing indicating indicia-bearing size caps to the top of a garment hanger is disclosed in U.S. Pat. Nos. 5,272,806 and 5,285,566 to Marshall, et al. which are assigned to the assignee of the present invention.

The system disclosed in the Marshall, et al. patents discloses an improvement to the Hangermatic 589 device and includes a third magazine to receive a bundle of size caps which are individually attached to the hangers as they are dispensed. Each of the magazines on the improved Hangermatic are independently adjustable to configure the device to variety of hanger configurations. In the Marshall et. al. device, the configuration of the reciprocating plate is altered to provide a cutout which conforms to the exterior dimension of the color and index-coded size cap. In operation, a single index size cap and a single hanger are withdrawn from their respective magazines and the index cap is secured to the hanger as the plate reciprocates forwardly to the extended position for attachment of a garment.

However, none of the above-mentioned devices can accommodate newer model pants hangers, which have a spring action pinch grips. These prior art devices are unsuitable for use with the pinch grip hangers since both pinch grips are normally biased to a closed position by a spring and both must be opened to load a garment into the grips. At the present time this requires an operator to perform four steps. Using one hand the operator must open the first pinch grip and then using the other hand to suspend the garment, one side of the garment is placed in the grip. This process is then repeated for the other pinch grip. With the second pinch grip the operator must also simultaneously tension the garment between the clips, and since both hands are already occupied, the tensioning step may require additional manual movements. At a minimum, four manual steps or movements are required.

Further, some pinch grip hangers have plastic hooks, adapted to receive a size cap related to a characteristic of the garment to be loaded into the hanger. The placement of the size cap on each device requires either a separate machine, such as the previously described prior art device, or manual application of the size caps. Therefore, the labor required to correctly load or secure and size the garment is increased, resulting in higher labor costs and lower productivity.

The object of the present invention is to overcome these obstacles with a mechanism which automatically presents the hanger to the operator and automatically opens and closes the new style hanger clips for insertion of the garment. Optionally, the invention can automatically attach the size cap on the hanger as it is presented to the operator for garment loading. The invention promotes safe and efficient operation of the placement of garments and size indicias on pinch grip hangers.

BRIEF SUMMARY OF THE INVENTION

The present invention relates to a pinch grip hanger mechanism, which allows an operator to safely, quickly, and efficiently attach garments to hangers. In the preferred embodiment of the invention the device includes a magazine for holding a plurality of hangers. A reciprocating push plate removes a single hanger from the magazine while advancing it in a first direction to a stop position. At the stop position movement of the hanger in the first direction ceases. A means for actuating the pinch grip cylinders is initiated when the hanger reaches the stop position. When the hanger ceases movement, each of two pinch grip cylinders project a ram onto each of the two pinch grips of the hanger, which enables the simultaneous opening of both hanger pinch grips. A means is provided for actuating the pinch grip cylinders a second time when the garment is loaded, which retracts the projected ram, enabling the pinch grips of the hanger to close. When the pinch grips of the hanger are closed and the rams retracted, the operator can remove the hanger/garment combination, and hang it on a rack for delivery to a shipping container. As the garment is removed, the reciprocating push plate is actuated to reciprocate the push plate in a second direction to retract the plate and then begin another cycle of operation.

The invention further includes a safety trigger mechanism that allows the pinch grip cylinders to be remotely actuated by the insertion and removal of the garment, while the garment is held between the hands of the operator. This triggering arrangement prevents inadvertent injury to the operator, since both hands are outside the device when the pinch grip cylinders are being actuated.

DETAILED DESCRIPTION OF THE INVENTION

Figure 1:
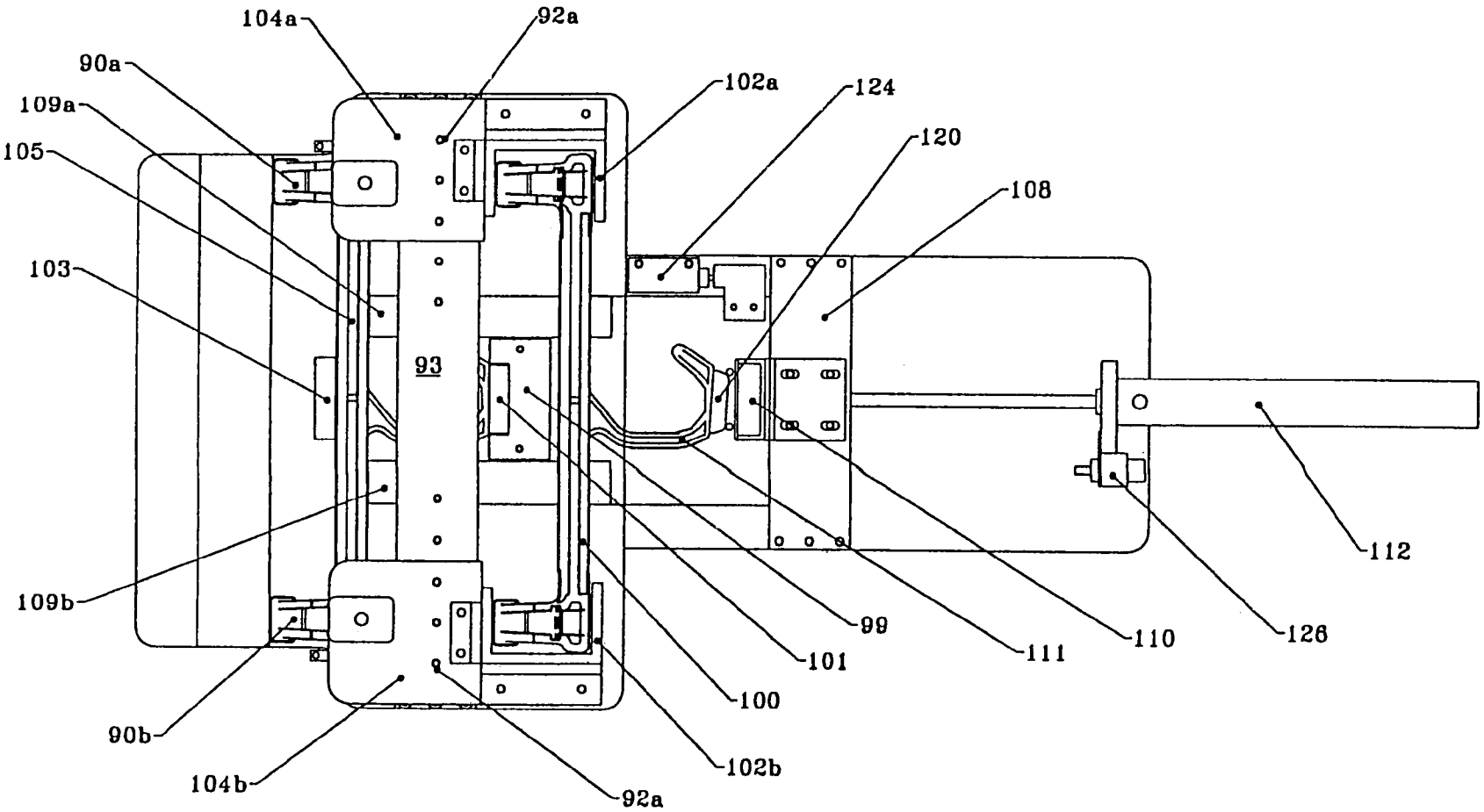
FIG. 1 is a plan view of the hanger mechanism of the present invention illustrating a plurality of hangers in the magazine and a hanger extended to the garment loading position.
Figure 2:
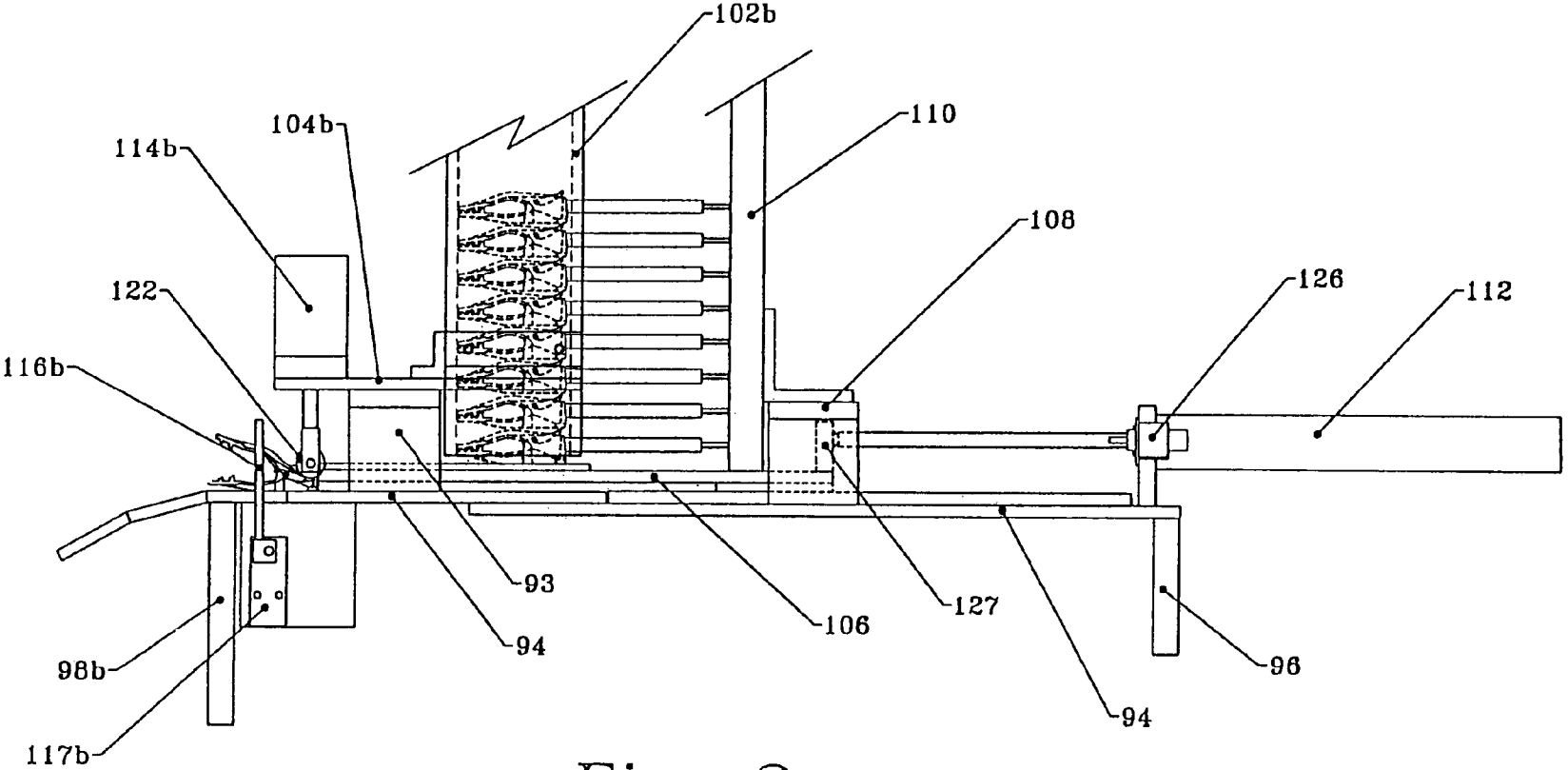
FIG. 2 is a side elevation view of the hanger mechanism, illustrated in FIG. 1 with hangers in the magazine and a hanger extended to the garment loading point.

This invention relates to a device, which is intended for use in the garment industry. Specifically, this device promotes the safe and efficient operation of placing garments on hangers for subsequent shipment and display. The present invention is intended for use with pinch grip hangers.

As illustrated in FIG. 1–5, the present invention includes a number of symmetrical parts, both in the pinch grip mechanism described and the hanger loaded in the mechanism. In many cases, a single functional element, such as the hanger magazine 102 is formed of two symmetrical parts 102*a*, 102*b*. In the description that follows, reference to a part having symmetrical components may occur with the use of a single reference numeral, referring to both parts, in order to facilitate the description.

Figure 5:
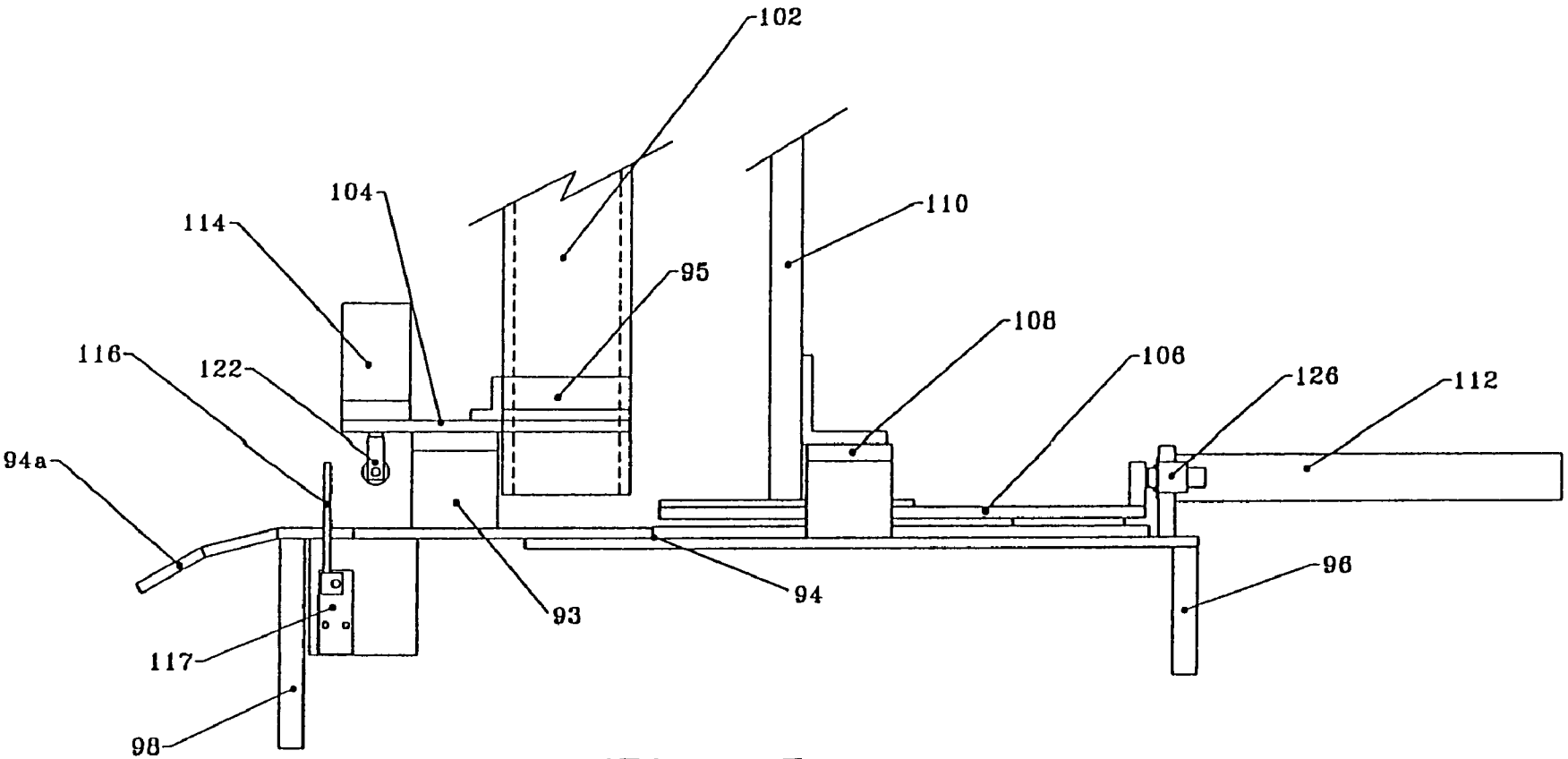
FIG. 5 is a side elevation view of the hanger mechanism, which further illustrates the garment insertion triggers and magazine positioning.

As illustrated throughout the Figures, a hanger magazine 102 is provided for vertically storing and loading a plurality of hangers 100 for the mechanism. The hangers are placed in the magazine 102 either singularly or as an attached group of hangers held together by a clip (not illustrated). The magazine includes a pair of upwardly extending receptacles 102*a*, 102*b* that are spaced above a main base 94, as best illustrated in FIG. 5. When hangers are loaded into the magazine, each hanger is oriented flat to the horizontal main base 94 with the clip portion of the hanger having its opening side facing the operator.

Figure 3:
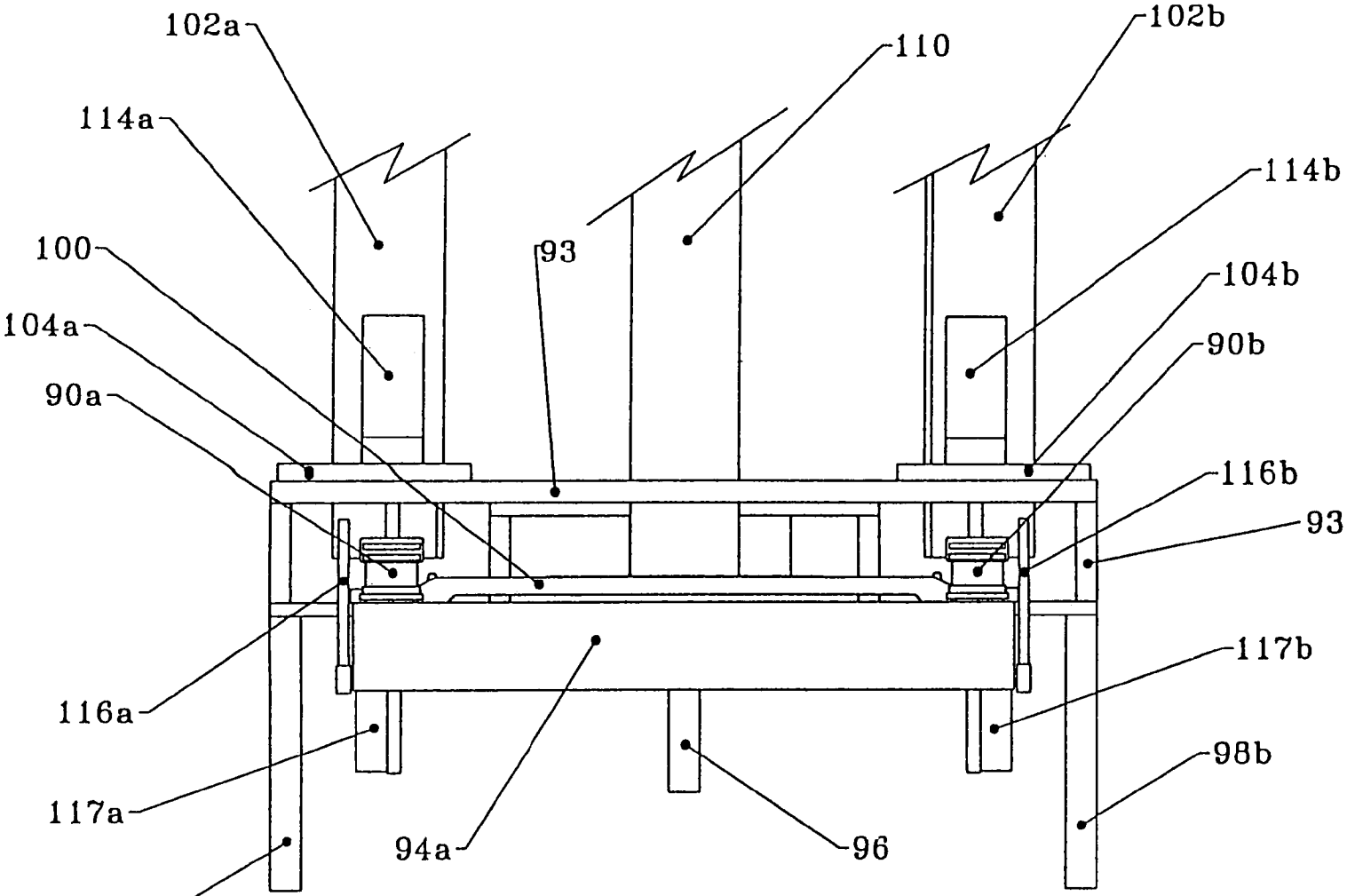
FIG. 3 is a front elevation view of the hanger mechanism further illustrating the present invention with the pinch grip rams extended and the hanger pinch grips open for garment loading.
Figure 4:
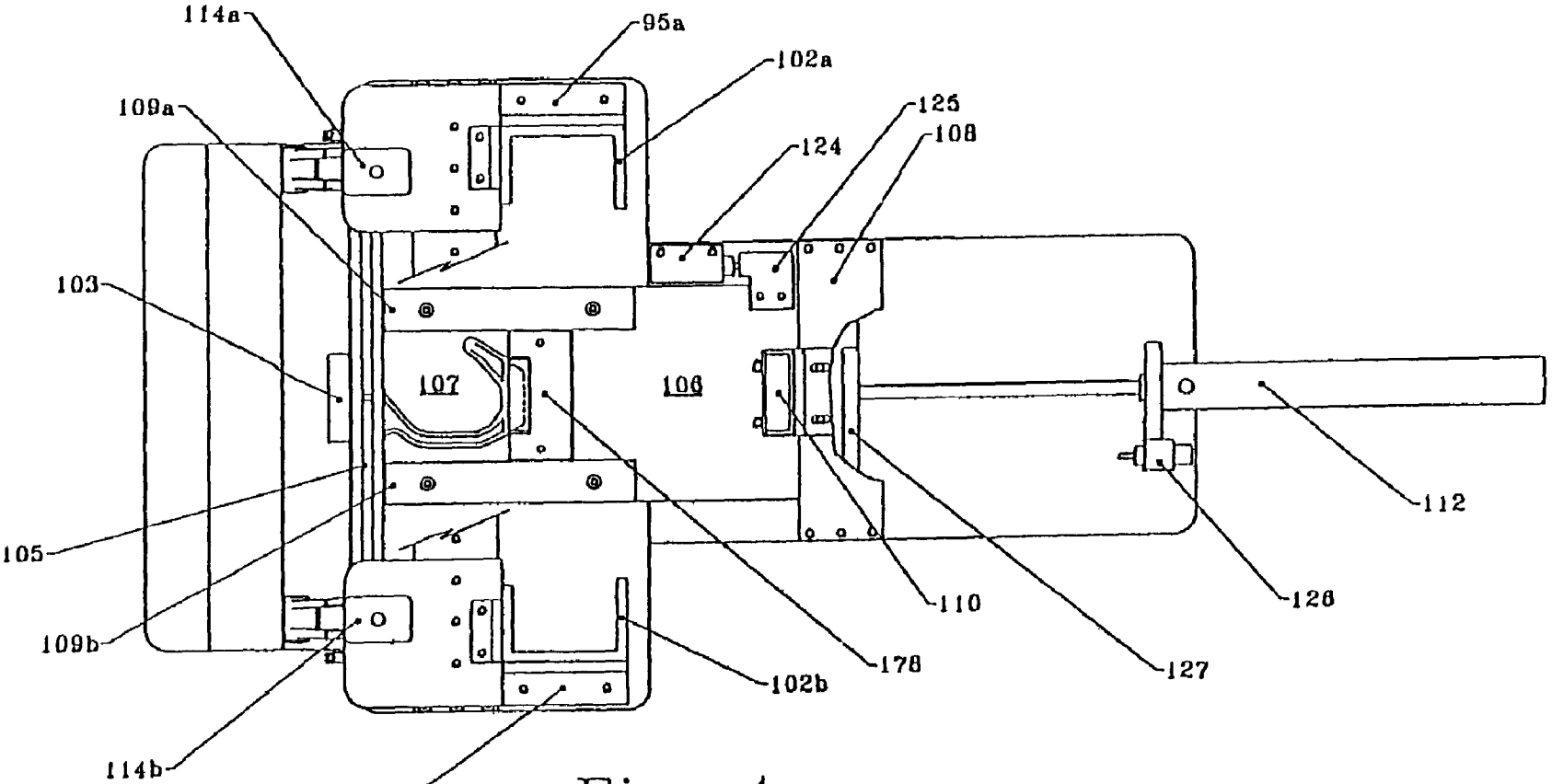
FIG. 4 is a plan view of the hanger mechanism with the hanger push plate extended, and a hanger positioned at the garment loading point.

As shown in FIG. 1, 4 and 5, the magazines 102*a*, 102*b* are adjustably suspended above main base 94, and attached to intermediate base members 104*a*, 104*b* by means of brackets 95*a*, 95*b*. Pinch grip ram cylinders 114 are used to open the hanger pinch grips, and are also attached to base members 104 as illustrated in FIGS. 3 and 5. Intermediate base members 104 are supported above main base 94 by means of inverted unshaped support bracket 93. The brackets 95*a*, 95*b* suspend the magazines 102*a*, 102*b* from the base members 104*a*, 104*b*, so that the lower portions of magazines 102*a*, 102*b* are elevated a defined distance above main base 94, as will be hereinafter discussed in detail. The main base 94 is supported by legs 98*a*, 98*b* and 96, which together provide a stable platform for the device and allow the device to be located at an elevation and location convenient to the operator.

The distance between base members 104*a* and 104*b* can be laterally adjusted on support 93 to allow various sizes of hangers 100 to be used in the mechanism. The base members 104 are adjusted by means of adjustment holes, two of which are identified at 92*a*, 92*b*. This enables magazines 102*a*, 102*b* and ram cylinders 114*a*, 114*b* to be moved into proper positions on either side of a centerline axis of the mechanism for use of the mechanism with various hanger lengths or sizes. In a preferred embodiment of the mechanism, the centerline axis is defined by the reciprocal movement of the push plate 106.

The push plate 106 is designed so that other hangers in the magazine 102 are retained in the magazine, and do not snag on the push plate 106 or otherwise leave the magazine when the push plate is in motion. The feed mechanism is a "slice feeder" in which the push plate 106 reciprocates back and forth under the magazine 102 and appears to be slicing off a single hanger 100 with each reciprocation. The dimensions and position of the push plate 106 with respect to the magazine 102 may be adjusted so that the device can accommodate a variety of hanger thickness, or alternately the device may utilize matched sets of magazines and plates, with each set appropriate for a specific hanger design. In operation, the next hanger in the magazine 102 is only released from the magazine 102 when the push plate has fully reciprocated to its rearward position, as illustrated in FIG. 5. As the push plate 106 is retracted under the magazines 102, a single hanger 100 is released from the magazine and drops onto main base 94. The bottoms of magazines 102 are adjusted to be approximately one hanger thickness above the main base 94. As the push plate begins its cycle of operation, the push plate 106 reciprocates forwardly to engage the hanger 100 on main base 94. As illustrated in FIG. 4, the hook of the hanger is not initially engaged, as it falls into a cut out portion 107 in the push plate 106 that extends between two hanger engaging arms 109*a* and 109*b*. As the push plate 106 advances, the engaging arms 109*a*, 109*b* engage the horizontal support bar 105 of the hanger 100, and begin to advance the hanger towards the operator. Only a single hanger is advanced at a time, since the dimensions of the slot below the magazine and the push plate 106 are too close to allow a subsequent hanger to be released. Alternatively, reciprocating pairs of alternating pins may be used at the base of each magazine to dispense a single hanger for each reciprocation of the push plate.

During the slice feeding, the push plate 106 moves forward and then backwards under the next to be dispensed hanger, with the push plate sliding under the next to be released hanger, which is constructed from movement by magazine 102. The sliding surface of push plate 106 prevents the hanger above the push plate 106 from dropping to the main base 94 until the push plate 106 is fully retracted to the position illustrated in FIG. 5. At that time, the next to be dispensed hanger is exposed to the main base 94, which allows the stack of hangers to drop downwardly so that the next hanger to be dispensed rests on the main base 94. This hanger is then advanced with the next reciprocation. Additionally, the push plate thickness of push plate 106 may be made variable with adjustable shims that will accommodate hangers having a different thickness. The thickness of the hanger and the dimensions of the dispensing slot and the thickness of the push plate 106 prevent multiple hangers in the magazine from being dispensed or causing the device to jam on a second hanger.

The present invention is intended to work with either wire hook hangers or plastic hook hangers, and the forgoing description is equally applicable to both types of hangers. Optionally, when plastic hook hangers are used, it may be desirable to automatically affix a size cap to the hanger at the time the hanger is positioned for garment loading. The following description is relevant to this option.

When desired, the present invention enables the size caps to be automatically attached to the hook portion 111 of the hanger 100. As illustrated in FIGS. 1–5, a size cap magazine 110 may be located between the hanger magazines 102*a*, 102*b* and the push plate reciprocating cylinder 112. The mechanism works in concert with the reciprocating action of the push plate 106. Again using a slice feeder, a portion of the push plate 106 is designed to remove a single size cap 101 from the size cap magazine 110 each time the device moves towards the operator, and is then affixed to the hanger as the hanger advances towards the operator. As described previously with respect to the hangers, subsequent size caps in the magazine are prevented from release from the size cap magazine 110 by the dimensions of the opening below the magazine, the thickness of the size cap and the thickness of the push plate 106 immediately following the receptacle or cut out for the size cap. The leading edges of the push plate arms 109*a*, 109*b* may be supplied with compressible resilient engaging means at the point of engagement with the hanger support bar 105. This resilient mounting allows the size cap to be forced onto the flange 120 of hanger hook 111 of the hanger 100, without placing extraordinary stress on the hanger hook 111, the flange 120 of hanger hook 111, or the hanger 100. Alternately, a separate resiliently mounted receptacle may be formed in the push plate 106 to receive the size cap prior to the engagement of the push plate arms 109*a*, 109*b* with the hanger support bar 105.

The following is an example of the operation of the present invention utilizing size caps 101 that are mounted on a hanger hook 111. Typically the hanger 100 and the size cap 101 have engagement formations which require a certain amount of force to overcome the resistance, but upon application of such force in the engagement of the two pieces, the hanger 100 and size cap 101 snap fit to one another. The snap fit may be permanent, as taught by U.S. Pat. No. 5,604,975, or releasable, as taught by U.S. Pat. No. 5,794,363. Both of these patents are assigned to the assignee of the present invention, and the disclosures of both patents are incorporated herein by reference thereto. As the push plate 106 begins its first reciprocal movement towards the operator, a size cap 101 is removed from the size cap magazine 110. The removed size cap is captured within a cut out or a receptacle 178 (illustrated in FIG. 4) mounted on the push plate 106 and fed to the flange portion 120 of the hook 111 to which it will be attached. Before the engagement arms 109*a*, 109*b* engage the hanger support bar 105, the size cap is advanced over the hanger flange 120, and by the time the engagement arms 109*a*. 109*b* engage the hanger, the flange 120 is positioned within an internal recess in the size cap 101. The hanger and size cap assembly, with the cap loosely applied to the flange 120 of the hanger 100, are moved towards a hanger stop position at hanger stop 103. Upon reaching the hanger stop 103, the hanger 100 and hanger bar 105 are stopped. However, the push plate 106 continues to move towards the operator a short distance. This distance enables compression of the resilient engagement tips at 109*a*, 109*b* which allows the push plate 106 to force the snap fit engagement of size cap 101 to flange 120 of hanger hook 111. Due to the compressive force imparted on the size cap by the push plate 106 as it moves through the resilient mounting at 109*a*, 109*b*, the size cap is firmly seated on hanger flange 120 in a snap fit engagement with the hanger. The resilient mounting of the push plate 106 insures that the force imparted upon the hanger 100 is not so great to damage the hanger hook 111 or the hanger support bar 105. Alternately the same effect may be accomplished by resiliently mounting a size cap receptacle to push plate 106. The resilient engagement allows a small amount of over travel which forces the size cap onto the hook without damaging the hook.

Alternately, the push plate portion 109 can be formed without such a resilient mounting at either location. In such instances, the velocity of the push plate 106 is great enough that on initial impact of the push plate 106 with the hanger 100, the inertia of the push plate overcomes the resistance of the snap fit engagement between the flange 120 and the size cap 101 and firmly secures the size cap 101 to the flange 120.

The push plate 106 is advanced and retracted by a reciprocating cylinder 112. In the example shown in FIGS. 1–5, the reciprocating cylinder 112 is a double acting pneumatic cylinder, however, it is understood that the reciprocating cylinder could be of a variety of other designs including but not limited to hydraulic cylinders, electric solenoids, or mechanical drives such as rack and pinion gear drive, or any other means of extending and retracting the push plate in an efficient manner. The reciprocal movement of the push plate 106 defines a centerline axis for the mechanism.

As the push plate 106 is advanced towards the operator, and after the push plate has engaged the size cap and hanger 100, and positioned the hanger at the hanger load position, a control engagement cam 125 (illustrated in FIG. 4) engages an pneumatic switch 124, which initiates a pneumatic signal which is sent through the pneumatic control system to actuate a pair of pinch grip cylinder rams 114*a*, 114*b*. The stroke of cylinder 112 limits the travel of the push plate 106 so that there is no further movement of the push plate after reaching a stop position and hanger stop 103. While FIG. 4 has illustrated the pneumatic switch 124 as mounted above main base 94 to better illustrate the mechanism for description, in the preferred embodiment, it is located below the main base 94 to facilitate mounting of the pneumatics. When the hanger reaches the stop position, each of the pinch grip cylinders 114*a*, 114*b* project rams 122*a*, 122*b* onto their respective pinch grips of the hanger 100, opening the pinch grips 90*a*, 90*b* and overcoming the opposition of the pinch grips spring which keeps the pinch grip in a normally closed position.

Figure 6:
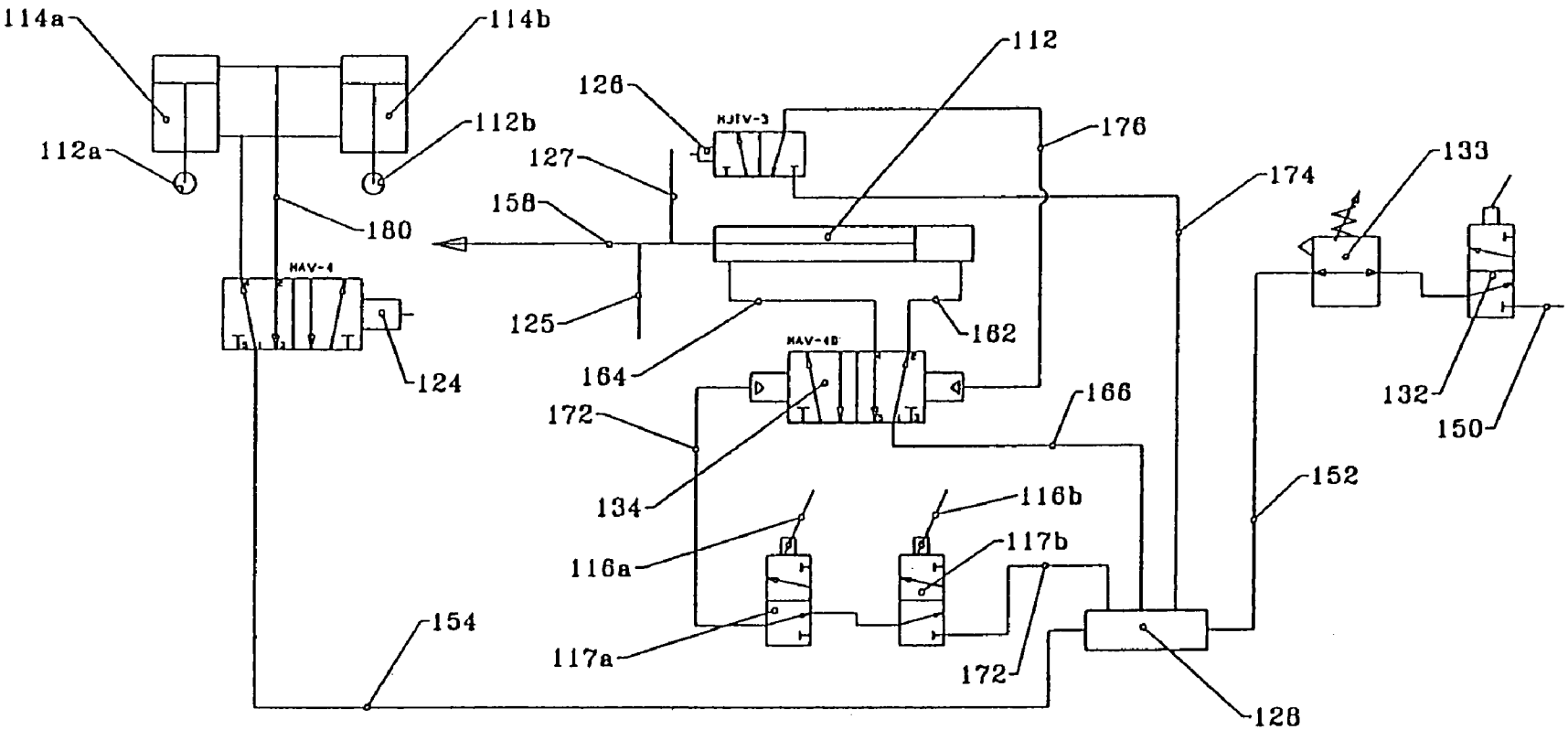
FIG. 6 is a schematic view of a pneumatic control circuit used in the preferred embodiment of the invention.

FIG. 6 illustrates a preferred pneumatic control circuit for use with the present invention. The control circuit is pneumatic, but the principles described below but could be adapted for a variety of control mechanisms, including electrical and hydraulic. The control circuit includes a supply valve 132, a pneumatic regulator 133, a manifold 128, reciprocating cylinder spool valve 134, a forward motion pneumatic valve 126, ram cylinder pneumatic valve 124, pneumatic control valves 117*a*, 117*b*, reciprocating cylinder 112, and pinch grip cylinders 114*a*, 114*b*.

As illustrated in FIG. 6, a pneumatic supply line 150 supplies pneumatic pressure for the operation of the device and the control system. An off/on switch 132 provides that when the apparatus is off, air pressure from the control system in the apparatus is vented to atmosphere. The air pressure from the on/off supply switch 132 may then be filtered, dried or otherwise treated and the system is protected from excess pressure by a pneumatic regulator 133. In the preferred embodiment, a low pressure control circuit is used having a range of 60 psi to 80 psi, with a nominal set point of 70 psi. The incoming pneumatic pressure is then routed via a supply line 152 to a supply manifold, schematically illustrated at 128. Air pressure for the actuation of the pinch grip cylinder 114(*a*) and 114(*b*) is provided via supply line 154 to the ram cylinder pneumatic valve 124. Ram cylinder pneumatic valve 124 is actuated by a control engagement cam 125 which is mounted on push plate 106, but is schematically illustrated in FIG. 6 as mounted on the cylinder rod 158 of the reciprocating cylinder 112. Also illustrated schematically is the reversing cam 127, which engages forward motion control valve 126, which initiates a new cycle of operation. As the reciprocating cylinder 112 is powered in extension, the cylinder rod 158 and push plate 106 are advanced in the direction of arrow A in FIG. 6 until the control engagement cam 125 engages ram cylinder pneumatic valve 124. As illustrated in FIG. 6, the pneumatic pressure in supply line 154 is powering the pinch grip cylinders 114(*a*) and 114(*b*) in the upward direction so that the ram 122(*a*) and 122(*b*) are retracted from their operating position. As the control engagement cam 125 engages ram cylinder pneumatic valve 124, the spool in valve 124 is displaced in the direction of arrow A, enabling the pneumatic cylinders 114(*a*) and 114(*b*) to be powered to extension, or downwardly, with rams 122(*a*) and 122(*b*) being directed downwardly into engagement with the pinch grips at the hanger load position. As illustrated in FIG. 6, the spool for valve 124 is spring loaded so that as long as the control engagement cam 125 remains in engagement with the ram cylinder pneumatic valve 124, the pneumatic cylinders 114(*a*) and 114(*b*) remain powered with the rams 122(*a*) and 122(*b*) engaging the pinch grips. As will be hereinafter explained, when the reciprocating cylinder 112 is retracted, the spool in ram cylinder pneumatic valve 124 will shift again to the position illustrated in FIG. 6, causing the pinch grips cylinders 114(*a*) and 114(*b*) to be powered upwardly, withdrawing the rams 122(*a*) and 122(*b*) from engagement with the pinch grips, and allowing the pinch grips to close on the garment being loaded.

As illustrated in FIG. 6, the reciprocating cylinder 112 is in a semi-retracted position after the reversing cam 127 has engaged forward motion control valve 126, and started extension in the direction of arrow A in FIG. 6. A controller 134 having a reversing spool controls the direction of movement for the reciprocating cylinder 112 by powering either pneumatic line 162 or pneumatic line 164. Supply manifold 128 supplies air under pressure through line 166 to controller 134 to supply line 162 to extend the reciprocating cylinder 112 and drive the pneumatic cylinder rod 158 in extension in the direction of arrow A. When reciprocating cylinder 112 is fully extended, the apparatus is at rest awaiting loading of a garment into the hanger by the operator. As the operator loads the garment into the hanger, the outside edges of the garment engage triggers 116(*a*) and 116(*b*), which actuate pneumatic valves 117*a* and 117*b*. Trigger control valves 117*a* and 117*b* are mounted in series so that both must be actuated before the circuit is reversed. The trigger circuit is powered through supply line 172(*a*) and upon actuation, the trigger control valves power supply line 172 to activate the controller 134 to shift the spool of the control valve 134 in the opposite direction. As supply the trigger control valves energize line 172, the spool valve of controller 134 shifts to the opposite position from the position illustrated in FIG. 6. When shifted, pneumatic line 164 will be pressurized which will then drive the reciprocating cylinder 112 and cylinder rod 158 in retraction, or in the opposite direction of arrow A, thereby retracting the push plate 106 from the stop position. As indicated above, as the cylinder rod 158 and control engagement cam 125 are retracted, the ram cylinder pneumatic valve 124 reverts to the position illustrated in FIG. 6, and the pinch grip cylinders 114(*a*) and 114(*b*) are driven upwardly, releasing the pinch grips to engage the garment.

Reciprocating cylinder 112 and cylinder rod 158 are then powered retraction, in the direction opposite the arrow A until the reversing cam 127 engages reversing forward motion control valve 126. When forward motion control valve 126 is actuated, air pressure from control line 174 is then used to energize control circuit 176 which will then drive the spool valve in controller 134 in the opposite direction, reversing the airflow to the reciprocating cylinder 112. This initiates a new cycle of operation, as the push plate 106 engages a new hanger from magazines 102*a*, 102*b*, and advances it to the stop position, to actuate ram cylinder pneumatic valve 124. Actuation of ram cylinder pneumatic valve 124 stops extension of the reciprocating cylinder as described earlier, and powers pneumatic line 180 to power the pinch grip cylinders 114, 114*b* to drive the rams 122*a*, 122*b* downwardly and open the hanger pinch grips 90*a*, 90*b*.

With the pinch grips 101 open and the hanger secured in the stop position, the operator can insert a garment into the now open pinch grips 101. As illustrated in FIG. 3 proximately located to the open pinch grips are triggering devices 116. The triggering devices 116*a*, 116*b* are actuated by the outer edges of the garment when the operator places the garment in the pinch grip clips 90*a*, 90*b*. In the preferred embodiment of the present invention, the triggers 116*a*, 116*b* are located immediately outside each of the pinch grips. The operator picks up a garment to be hung from the hanger 110, typically a pair of slacks or a skirt, and pulls the waistband taut between her hands. The taut waistband is then inserted into the pinch grips 101 with both hands on the outside of the device, whereby the triggers 116 are actuated by the portions of the garment that extends beyond the outer edges of the hanger. The device also employs a sloping garment guide 94*a* which joins main base 94 to assist the operator and guide the garment waist band into pinch grips 90*a*, 90*b*.

The placement of the triggers 116 to each side of the location where the garments are inserted provides an added safety feature for the device. Since there is no opportunity for an operator to inadvertently injure herself while operating the device. This is a result of the dual trigger mechanism, which necessitates that the operator grip the garment at its outer edges, and pull it taut for insertion. The operator must pull the garment outward at its ends with both hands to insure that there is no sagging of the garment between the grips. Thus, both of the triggers are tripped while the garment is in the proximate location after it is inserted into the pinch grips. As a result of requiring the operator to use both hands to hold the garment to trip the triggers, there is a reduced likelihood that the operator can inadvertently injure himself or herself. This increased safety is due largely to the fact that their hands are holding the ends of the garment, and therefore cannot inadvertently engage any of the reciprocating elements of the device.

Upon triggering, two actions take place. Instantly, the pinch grip cylinder rams 122(*a*) and 122(*b*) is retracted. The retraction allows the spring force of each pinch grip 90 to return to its normally closed position, thereby securely gripping the garment there between. This permits the operator to lift the hanger and garment combination off of the main base 94, and place the combination elsewhere for further processing. Secondly, the push plate 106 begins moving in a direction away from operator. As the push plate 106 passes the magazine 102, a new hanger 100 drops to the main base 94 and the process begins a new.

While several embodiments and variations of the present invention for a pinch grip hanger mechanism are described in detail herein, it should be apparent that the disclosure and teachings of the present invention will suggest many alternative designs to those skilled in the art.

The invention claimed is:

1. A pinch grip hanger mechanism for automatically dispensing pinch grip hangers and opening pinch grips to enable insertion of a garment by an operator, the mechanism comprising:

a magazine for holding a plurality of pinch grip hangers, each hanger having at least one pinch grip;

a push plate which engages a single hanger from the magazine, said push plate reciprocating from a hanger feed position to a hanger stop position in a first direction;

at least one ram positioned to project onto the at least one pinch grip of the hanger and opening said hanger pinch grip at the hanger stop position; and a trigger for automatically retracting the at least one ram following insertion of a garment by the operator.

2. A pinch grip mechanism as claimed in claim 1, which further comprises means to reciprocate the push plate in said first direction to said hanger stop position.

3. A pinch grip mechanism as claimed in claim 1, which further comprises a size cap magazine, said size cap magazine dispensing a single size cap with each movement of the push plate in said first direction.

4. A pinch grip hanger mechanism as claimed in claim 3, wherein the push plate further comprises a means for attaching the size cap to the hanger.

5. A pinch grip hanger mechanism as claimed in claim 4, wherein said mechanism further includes a hanger stop, to stop movement of the hanger in a first direction at said hanger stop position.

6. A pinch grip hanger mechanism as claimed in claim 1, wherein the push plate is actuated by a control circuit which enables automatic hanger feed to the operator following removal of a garment and hanger from the mechanism.

7. A pinch grip hanger mechanism as claimed in claim 1, wherein said push plate defines a cut-out portion for a hook of the pinch grip hanger so that pressure is applied to the arms of said hanger when moving the hanger in said first direction.

8. A pinch grip hanger mechanism as claimed in claim 1, wherein said trigger is located proximately to the at least one pinch grip of the hanger when in the hanger stop position, whereby said trigger is actuated when the operator places the garment in the pinch grips of the hanger.

9. A pinch grip hanger mechanism as claimed in claim 8, wherein said mechanism further includes a control circuit for enabling the retraction of the ram, thereby allowing the pinch grip to be closed, and the initiation of movement of the push plate in a second direction when said trigger is actuated.

10. A pinch grip hanger mechanism as claimed in claim 9, wherein said control circuit automatically reverses the push plate cylinder when it engages a retraction stop switch.

11. A pinch grip hanger mechanism as claimed in claim 9, wherein said control circuit automatically pauses the push plate cylinder when it engages an extension stop switch at said hanger stop position.

12. A pinch grip hanger mechanism as claimed in claim 8 in which said mechanism includes a pneumatic push plate cylinder to reciprocate said push plate and a pneumatic control circuit.

13. A pinch grip hanger mechanism as claimed in claim 12 in which said control circuit includes a reversible spool valve to reverse the movement of the pneumatic push plate cylinder when said trigger means is actuated.

14. A pinch grip hanger mechanism as claimed in claim 1 further including a bracket to adjustably mount said magazine and said ram a plurality of defined distances from a centerline axis to accommodate a plurality of hanger sizes.

15. A pinch grip hanger mechanism as claimed in claim 1 in which movement of said push plate in said first direction defines a centerline axis for the mechanism, with said magazine formed of two symmetrically spaced towers, said mechanism further including a bracket to adjustably mount said spaced towers and said first and second pinch grip cylinders a plurality of defined distances from said centerline axis to accommodate a plurality of hanger sizes.

* * * * *